US006517220B2

(12) United States Patent
Wu

(10) Patent No.: US 6,517,220 B2
(45) Date of Patent: Feb. 11, 2003

(54) DISASSEMBLY-TYPE LAMP SHADE STRUCTURE (2)

(76) Inventor: Wen-chang Wu, No. 10, Lane 191, Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 09/752,738

(22) Filed: Jan. 3, 2001

(65) Prior Publication Data

US 2002/0085382 A1 Jul. 4, 2002

(51) Int. Cl.[7] ..... F21V 1/06
(52) U.S. Cl. ..... 362/352; 362/357
(58) Field of Search ..... 362/352, 355, 362/356, 357, 358

(56) References Cited

U.S. PATENT DOCUMENTS 4,354,222 A * 10/1982 Gall ..... 362/352
6,315,434 B1 * 11/2001 Long ..... 362/352

FOREIGN PATENT DOCUMENTS

WO WO 92/04578 * 3/1992 ..... 362/352
WO WO 94/18496 * 8/1994 ..... 362/352

* cited by examiner

*Primary Examiner*—Laura K. Tso
(74) *Attorney, Agent, or Firm*—Troxell Law Office PLLC

(57) ABSTRACT

A disassembly-type lamp shade structure of simple assembly and reduced physical dimensions comprised of a top ring situated at the uppermost end of a lamp shade, a bottom ring of larger circumference than the top ring, and frame members propped between the top ring and the bottom ring. The top ring has notches respectively punch formed at the frame member support positions that provide for the placement of the frame members against them to position and limit the movement of the frame members or the rod-like body of the top ring is punch flattened on two sides to retain the supporting frame members such that after the punch flattening, the stop nubs thereby formed position and limit the movement of the frame members. The bottom ring has respectively disposed at the support positions of the frame members sleeve mounts into which they are respectively inserted. The sleeve mounts each have projecting upward a tubular keeper hole that provides for the fixed insertion of the frame members. After the frame member insert posts are slipped into the sleeve mounts, the sleeve mount keeper holes retain the member insert posts via an integrated press-fit lock annulus. The two sides of the bottom ring annular rod-like body to which each sleeve mount is conjoined are punch flattened such that after punch flattening, the stop nubs thereby formed position and limit the movement of the sleeve mounts. When packaged, the sleeve mounts are first rotated downward to enable the folding of the frame members fixed through insertion into the sleeve mounts. As such, the lamp shade of the present invention occupies the smallest physical assembly space to facilitate ease of assembly and, furthermore, the resulting minimized storage area effectively reduces shipping costs.

5 Claims, 7 Drawing Sheets

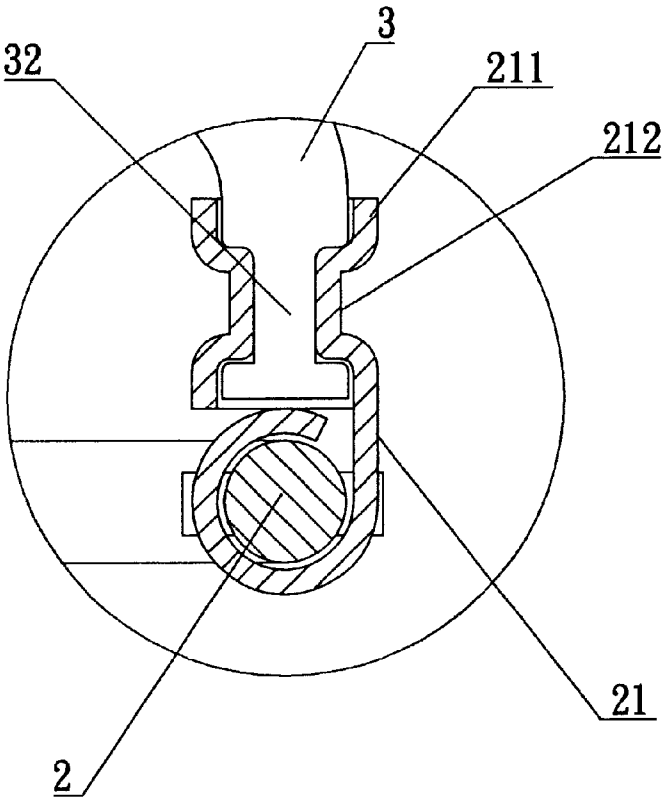
FIG2-C
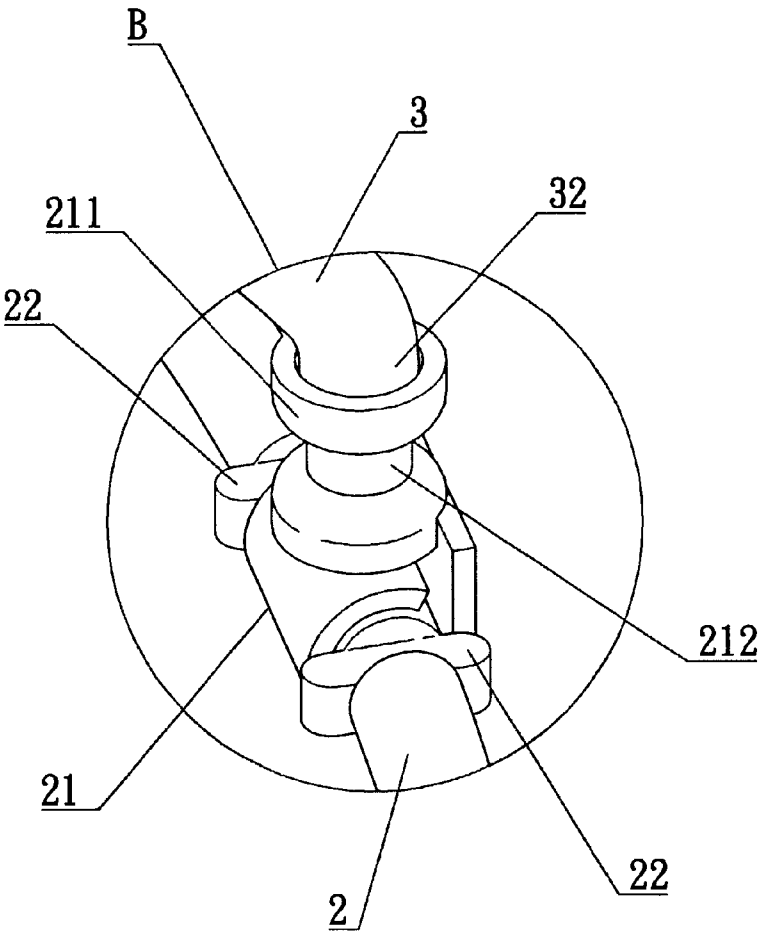
FIG2-B

DISASSEMBLY-TYPE LAMP SHADE STRUCTURE (2)

BACKGROUND OF THE INVENTION

1) Field of the Invention

The invention herein relates to a disassembly-type lamp shade structure in which the lamp shade top ring has notches respectively punch formed at the frame member support positions or the top ring is punch flattened on two sides to retain the supporting frame members to thereby position and limit the movement of the frame members; in addition, the bottom ring has respectively disposed at the support positions of the frame members sleeve mounts that provide for the insertion of the frame members; furthermore, the two sides of the bottom ring annular rod-like body to which each sleeve mount is conjoined are punch flattened such that after punch flattening, the stop nubs thereby formed position and limit the movement of the sleeve mounts. When packaged, the frame members are first folded for easy assembly and, furthermore, the resulting minimized storage area effectively reduces shipping costs.

2) Description of the Prior Art

A conventional lamp shade 5, referring to FIG. 6, typically has its frame members permanently fixed between the top ring and the bottom ring to form a lamp shade structure; however, since its structure is imperfect, the numerous practical shortcomings that result include the following example.

Since the conventional lamp shade 5 is a structural entity of an unyielding shape, when it is packaged in a carton, the lamp shade 5 cannot be forcefully diminished in size and no reduction in large storage volume is possible, which leads to a proportional increase in product shipping costs and results in greater overhead.

In view of the said shortcomings, the inventor of the invention herein conducted extensive research that culminated in the successful development of a disassembly-type lamp shade structure that entirely eliminates the drawbacks of the conventional product and, furthermore, is capable of significantly greater practicality.

SUMMARY OF THE INVENTION

The primary objective of the invention herein is to provide a disassembly-type lamp shade structure comprised of a top ring, a bottom ring, and frame members propped between the top ring and the bottom ring, wherein the top ring has notches respectively punch formed at the frame member support positions to position and limit the movement of the frame members; or, the rod-like body of the top ring is punch flattened on two sides to retain the supporting frame members such that after the punch flattening, the stop nubs thereby formed position and limit the movement of the frame members; the bottom ring has respectively disposed at the support positions of the frame members sleeve mounts each having projecting upwardly a tubular keeper hole that provides for the fixed insertion of the frame members; furthermore, after the frame member insert posts are slipped into the sleeve mounts, the sleeve mount keeper holes retain the frame member insert posts via an integrated press-fit lock annulus; furthermore, the two sides of the bottom ring annular rod-like body are punch flattened such that after punch flattening, the stop nubs thereby formed position and limit the movement of the sleeve mounts; when packaged in a carton, the sleeve mounts are first rotated downward enable the folding of the frame members fixed through insertion into the sleeve mounts and, as such, the lamp shade occupies the smallest physical assembly space and is thereby easily assembled and, furthermore, the resulting minimized storage area effectively reduces shipping costs.

Another objective of the invention herein is to provide a disassembly-type lamp shade structure in which the top ring has notches respectively punch formed at the frame member support positions that provide for the placement of the frame members against them to thereby position and limit the movement of the frame members; the frame members are fork-shaped at both their top ends and bottom ends, with matching notches respectively punch formed at the frame member positions along the top ring and the bottom ring that provide for the placement of the frame members against them to thereby position and limit the movement of the frame members; as such, the lamp shade occupies the smallest physical assembly space and is thereby easily assembled and, furthermore, the resulting minimized storage area effectively reduces shipping costs.

To enable the examination committee a further understanding of the structure and innovative features of the present invention, the brief description of the drawings below are followed by the detailed description of the invention herein.

BRIEF DESCRIPTION OF THE DRAWINGS

FIG. 2-A is an isometric drawing of the support section at the top ring and a frame member, as shown in a magnified view.

FIG. 2-B is an isometric drawing of the insertion section at the sleeve mount and a frame member, as shown in a magnified view.

FIG. 2-C is a cross-sectional drawing of the sleeve mount and frame member assembly, as shown in a magnified view.

FIG. 4-A is an isometric drawing of the flattening at the top ring and frame members.

FIG. 5-A is a cross-sectional drawing the lamp shade adhesion section, as shown in a magnified view.

DETAILED DESCRIPTION OF THE INVENTION

Figure 1:
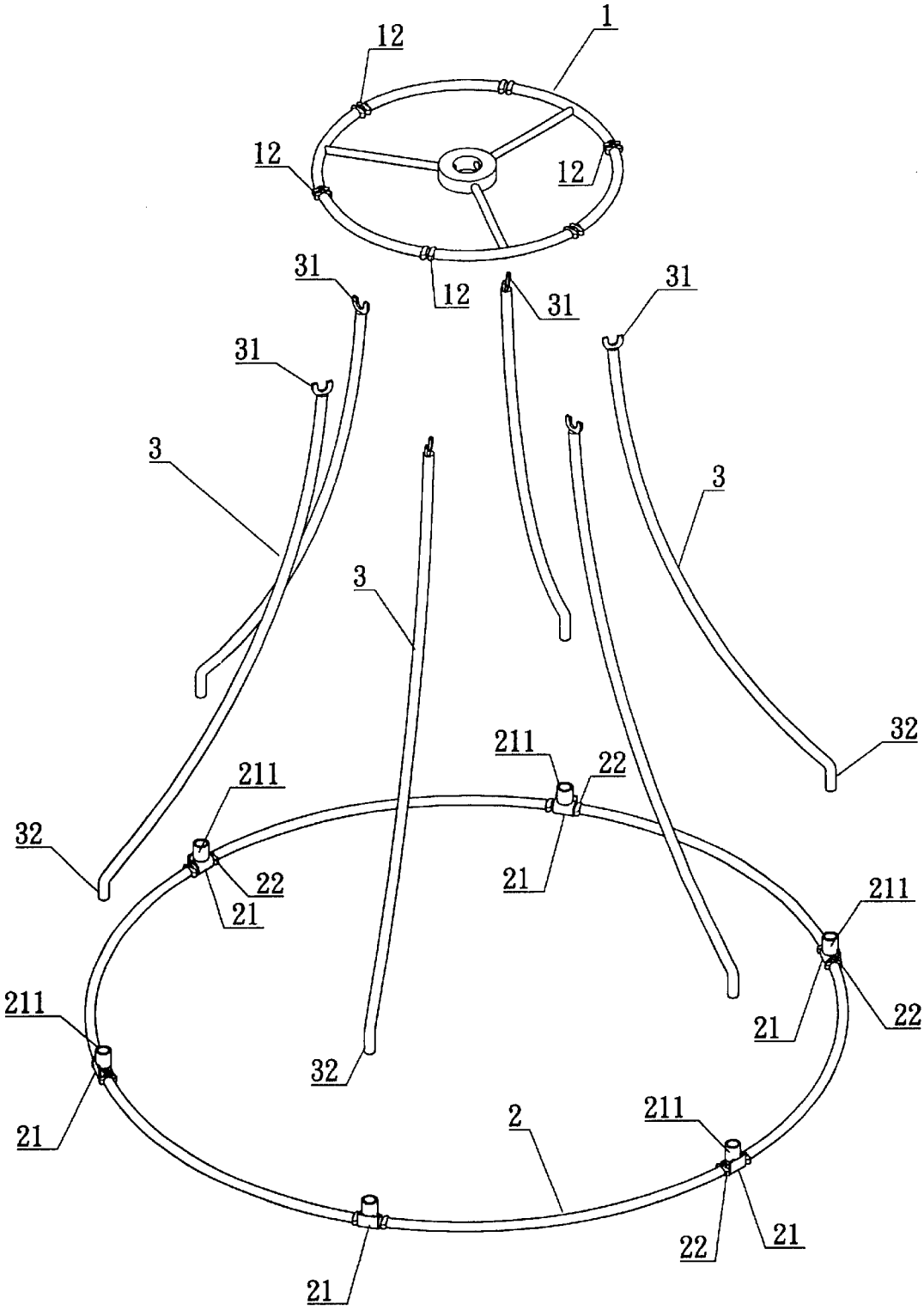
FIG. 1 is an exploded drawing of the invention herein.
Figure 2:
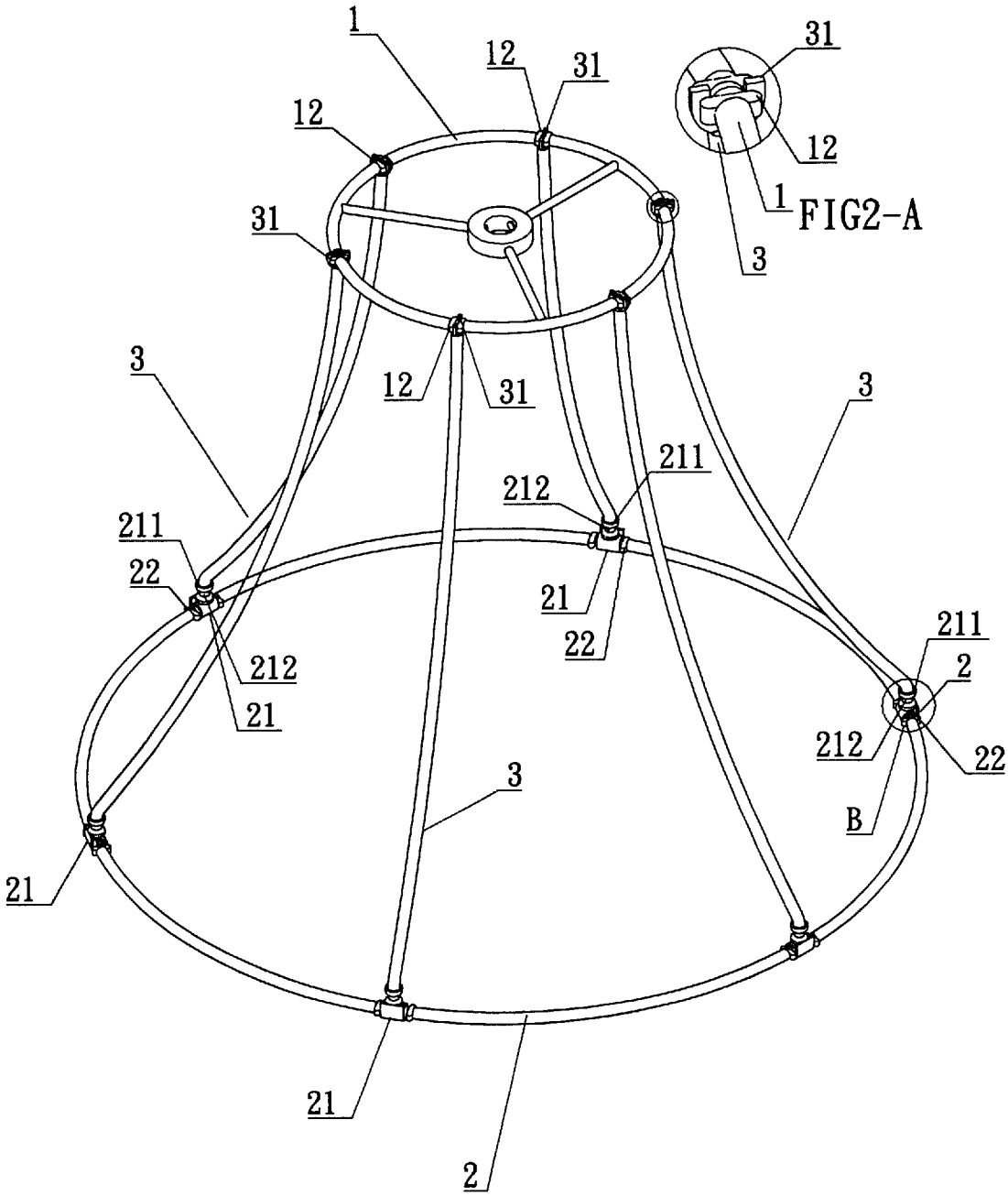
FIG. 2 is an isometric drawing of the invention herein.

Referring to FIG. 1 and FIG. 2, the drawings of the structural arrangement of the present invention, the invention herein is comprised of a top ring 1 situated at the uppermost end of a lamp shade, a bottom ring 2 of larger circumference than the top ring 1, and frame members 3 propped between the top ring 1 and the bottom ring 2.

The top ring 1 is of annular metal construction and, furthermore, is placed against the columnar lamp pipe structure, with the top ring 1 having notches 11 (see FIG. 4A) respectively punch formed at the frame member 3 support positions; or, the rod-like body of the top ring 1 is punch flattened on two sides to retain the supporting frame members 3 such that after the punch flattening, the stop nubs 12 thereby formed position and limit the movement of the frame members 3.

The bottom ring 2 has respectively disposed at the support positions of the frame members 3 sleeve mounts 21 into which they are inserted; the sleeve mounts 21 each have projecting upward a tubular keeper hole 211 that provides for the fixed insertion of the frame members 3; furthermore, the two sides of the bottom ring 2 annular rod-like body to which each sleeve mount 21 is conjoined are punch flattened such that after punch flattening, the stop nubs 22 thereby formed position and limit the movement of the sleeve mounts 21.

The said frame members 3 are fork-shaped 31 at their top ends and, furthermore, capable of resting inward against the notches 11 and the frame member 3 bottom ends are bent so they meet with the bottom ring 2 in a perpendicular arrangement and, furthermore, the insert posts 32 thereby formed are capable of being slipped into the sleeve mount 21 keeper holes 211 such that after the frame member 3 insert posts 32 are slipped into the sleeve mounts 21, the sleeve mount 21 keeper holes 211 retain the frame member 3 insert posts 32 via an integrated press-fit lock annulus 212 such that the frame members 3 are thereby fixed onto the sleeve mounts 21, but are capable of rotating with the sleeve mounts 21.

Figure 3:
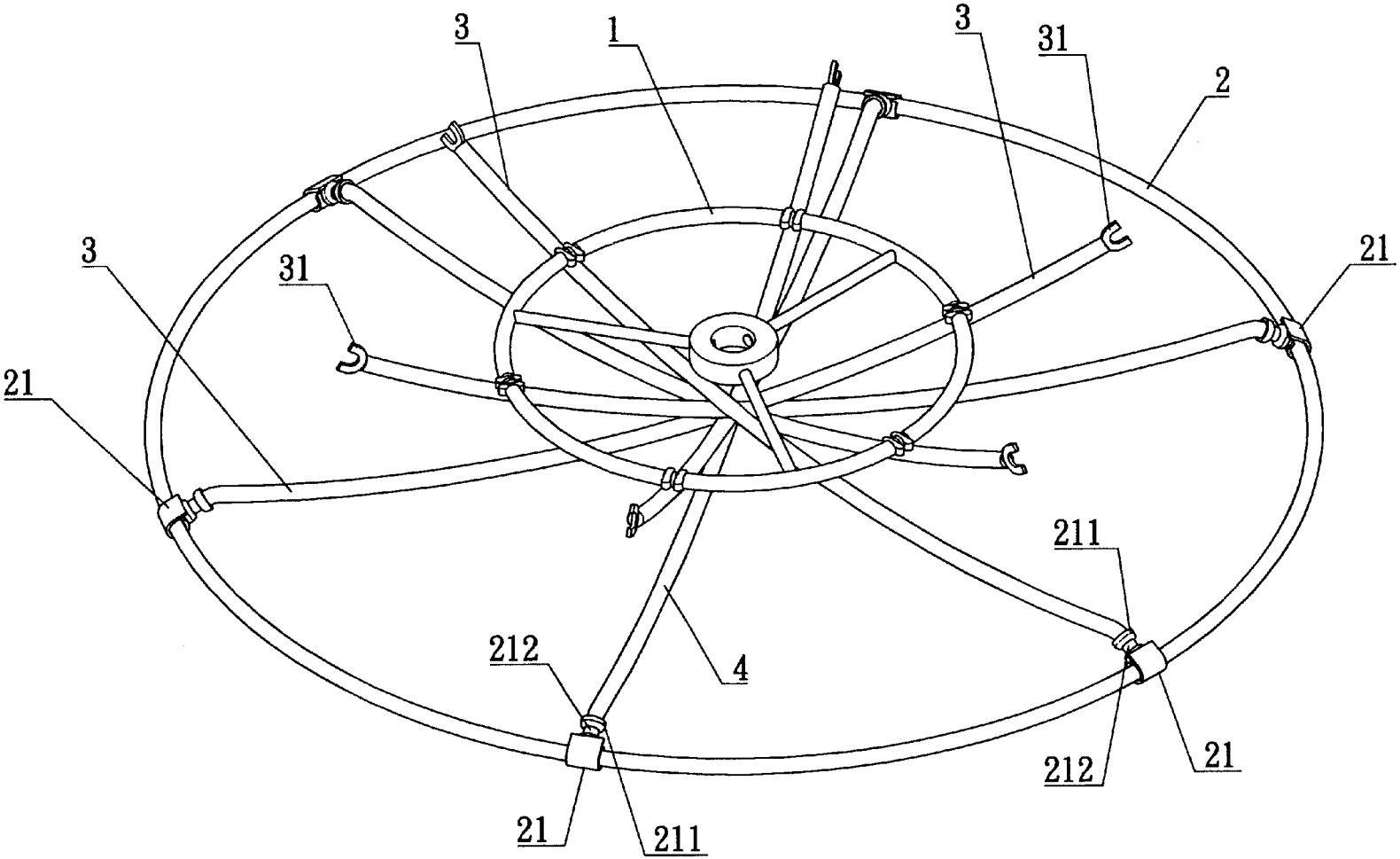
FIG. 3 is an isometric drawing of the invention herein in the folded state.

Referring to FIG. 3, since the sleeve mounts 21 are only yoked onto the bottom ring 2, they can be rotated on the bottom ring 2; when the lamp shade is packaged in a carton, the frame members 3 are removed from the top ring 1 and then the sleeve mounts 21 are rotated downward to enable the folding of the frame members 3 fixed through insertion into the sleeve mounts 21 and, as such, the lamp shade occupies the smallest physical assembly space to facilitate ease of assembly and, furthermore, the resulting minimized storage area effectively reduces shipping costs.

Figure 4:
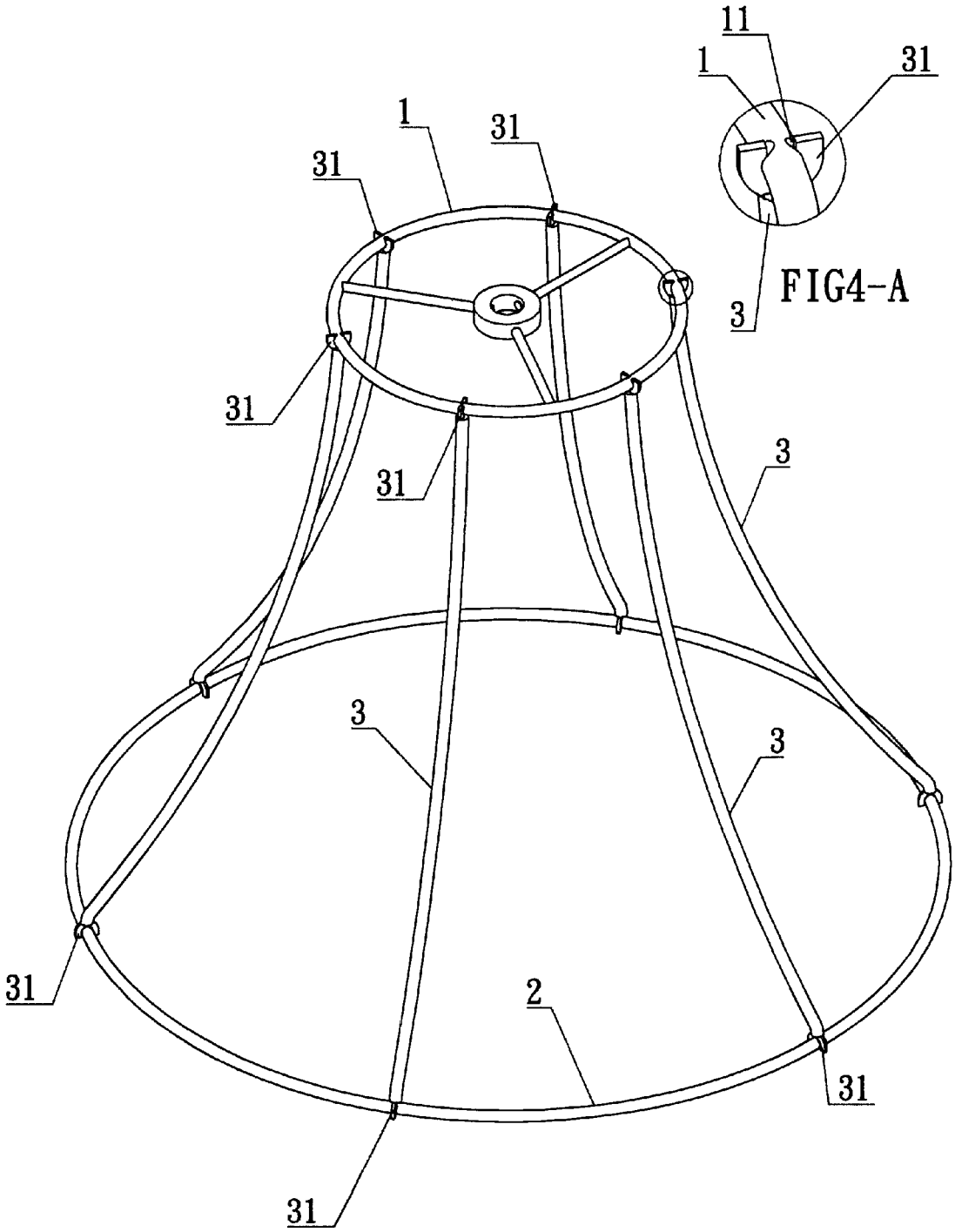
FIG. 4 is an isometric drawing of another embodiment of the invention herein.

Referring to FIG. 4, the drawing of another embodiment of the invention herein, the frame members 3 are fork-shaped 31 at both their top ends and bottom ends, with matching notches 11 respectively punch formed at the frame member 3 positions along the top ring 1 and the bottom ring 2 or the rod-like body of the top 1 and bottom ring 2 are punch flattened at two sides for the frame members 3 such that after the punch flattening, the stop nubs 12 and 22 thereby formed position and limit the movement of the frame members 3.

Figure 5:
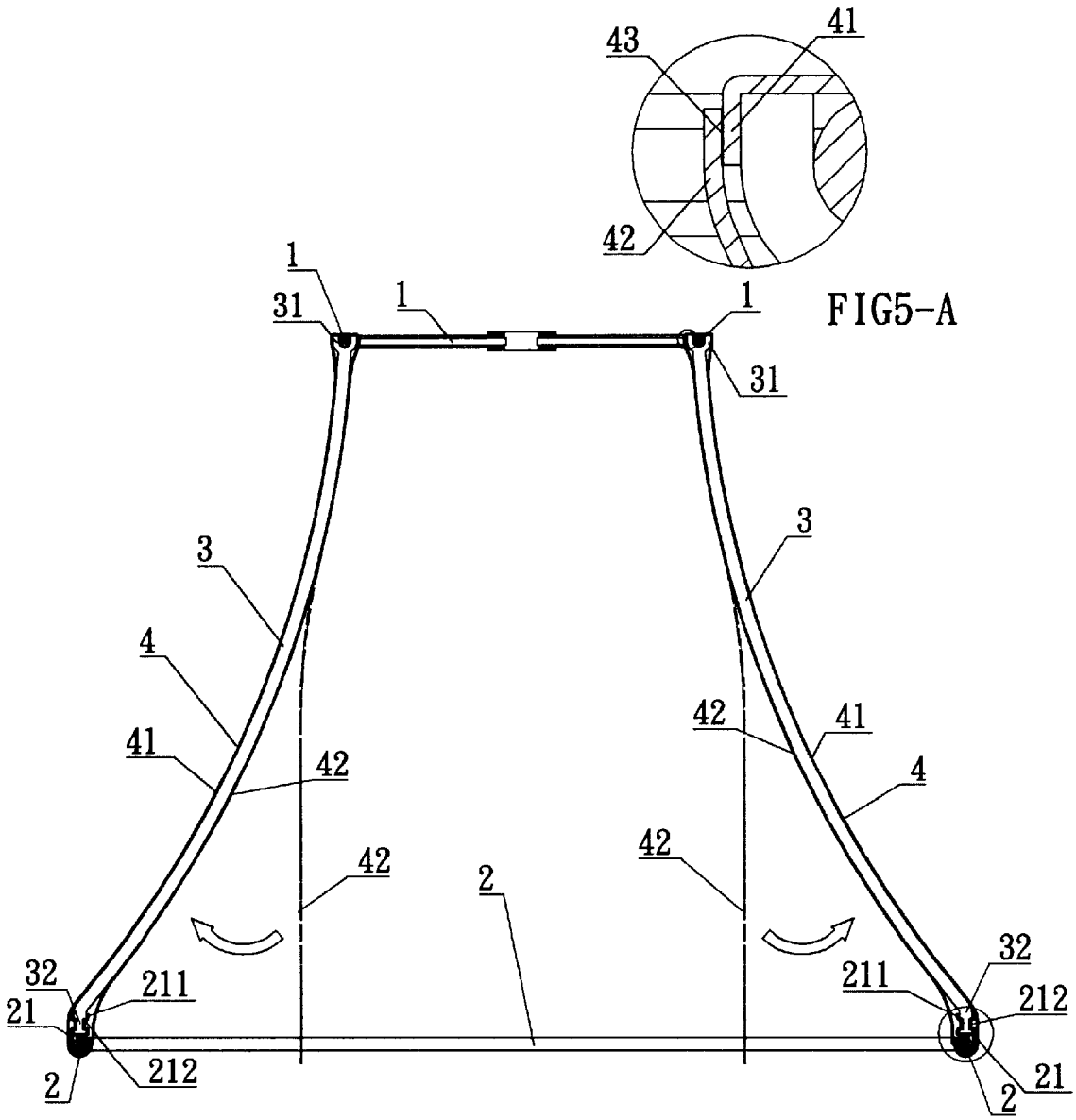
FIG. 5 is a cross-sectional drawing of the installed lamp shade of the invention herein.
Figure 6:
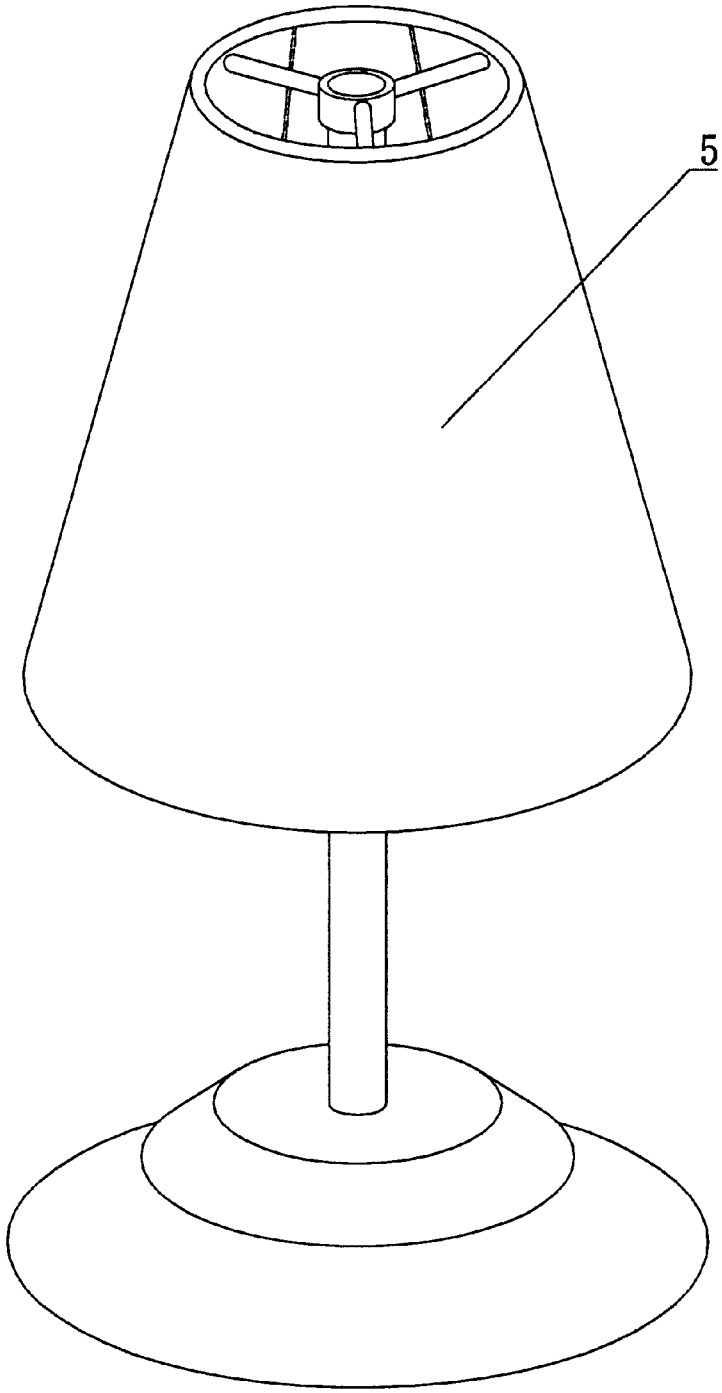
FIG. 6 is an isometric drawing of a conventional lamp shade.

Referring to FIG. 5, after the assembly of the lamp shade frame is completed, the top ring 1 and the bottom ring 2 are wrapped in an enshrouding fabric material lamp shade 4, wherein an exterior fabric surface layer 41 of the lamp shade 4 is first tightly fitted onto the outer periphery of the frame members 3; additionally, an interior fabric surface layer 42 is placed along the inner sides of the frame members 3 and, furthermore, an adhesive fastening tape 43 is respectively applied over the bottom ends of the interior fabric surface layer 42 and the exterior fabric surface layer 41, the frame members 3 are enveloped within such that the frame members 3 remain unexposed due to the ensconcing structural arrangement constituted by the interior fabric surface layer 42 and the exterior fabric surface layer 41, while also effectively achieving an attractive appearance; in addition, when the frame is folded, the attached lamp shade 4 collapses along with it to achieve a reduction in material storage area and thereby effectively lower shipping costs.

In summation of the foregoing section, since the disassembly-type lamp shade structure of the invention herein possesses innovative structural features which positively provide significantly greater practical functionality than that of conventional products, the patent application of the present invention is lawfully submitted for review and the granting of the commensurate patent rights in accordance with the spirit of the patent law encouraging the promotion of legitimate invention.

What is claimed is:

1. A disassembly-type lamp shade comprising: a top ring, a bottom ring, and frame members propped between the top ring and the bottom ring, wherein:

the top ring has frame member support positions that provide for the placement of the frame members against the top ring to position and limit movement of the frame members;

the bottom ring has respectively disposed at support positions of the frame members sleeve mounts into which the frame members are inserted, the sleeve mounts each have projecting upwardly a tubular keeper hole that provides for fixed insertion of one of the frame members, the bottom ring to which each sleeve mount is conjoined is punch flattened on opposite sides of the sleeve mounts, such that after punch flattening, stop nubs thereby formed position and limit movement of the sleeve mounts; and, the frame members are fork-shaped at top ends thereof, and, engage the top ring, bottom ends of the frame members are bent and inserted into the tubular keeper holes of the sleeve mounts such that, after the frame members engage the sleeve mounts, the sleeve mount keeper holes retain the frame members via an integrated press-fit lock annulus.

2. A disassembly-type lamp shade comprising a top ring, a bottom ring and frame members propped between the top ring and the bottom ring, wherein:

the top ring has notches respectively punch formed at frame member support positions that provide for the placement of the frame members against the top ring position and limit the movement of the frame members; and the frame members are fork-shaped at top and bottom ends, and engage the notches respectively punch formed in the top ring and the bottom ring thereby providing for the placement of the frame members against the top and bottom rings to position and limit movement of the frame members relative to the top and bottom rings.

3. The disassembly-type lamp shade as claimed in claim 1 wherein the support positions on the top ring are punch flattened at two sides forming stop nubs to limit movement of the frame members.

4. The disassembly-type lamp shade as claimed in claim 1 wherein the top ring and the bottom ring are wrapped in an enshrouding fabric material including an exterior fabric surface layer tightly fitted onto an outer periphery of the frame members, an interior fabric surface layer placed along inner sides of the frame members and an adhesive fastening tape applied over bottom ends of the interior fabric surface layer and the exterior fabric surface layer, whereby the frame members are enveloped.

5. The disassembly-type lamp shade as claimed in claim 2 wherein the top ring and the bottom ring are wrapped in an enshrouding fabric material including an exterior fabric surface layer tightly fitted onto an outer periphery of the frame members, an interior fabric surface layer placed along inner sides of the frame members and an adhesive fastening tape applied over bottom ends of the interior fabric surface layer and the exterior fabric surface layer, whereby the frame members are enveloped.

* * * * *